US010756437B2

(12) United States Patent
Saldivar Morales

(10) Patent No.: US 10,756,437 B2
(45) **Date of Patent: *Aug. 25, 2020**

(54) SYSTEMS, DEVICES AND METHODS FOR FLEXIBLE MEANDER LINE PATCH ANTENNA

(71) Applicant: Taoglas Group Holdings Limited, San Diego, CA (US)

(72) Inventor: Juan Alberto Saldivar Morales, Baja California (MX)

(73) Assignee: TAOGLAS GROUP HOLDINGS LIMITED, Enniscorthy, County Wexford (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/512,117

(22) Filed: Jul. 15, 2019

(65) Prior Publication Data

US 2020/0014110 A1 Jan. 9, 2020

Related U.S. Application Data

(63) Continuation of application No. 15/401,393, filed on Jan. 9, 2017, now Pat. No. 10,355,360.

(60) Provisional application No. 62/344,818, filed on Jun. 2, 2016, provisional application No. 62/281,009, filed on Jan. 20, 2016.

(51) Int. Cl.

| | |
|---|---|
| ***H01Q 9/04*** | (2006.01) |
| ***H01Q 1/36*** | (2006.01) |
| ***H01Q 1/48*** | (2006.01) |
| ***H01Q 5/364*** | (2015.01) |

(52) U.S. Cl.
CPC ..... *H01Q 9/0407* (2013.01); *H01Q 1/36* (2013.01); *H01Q 1/48* (2013.01); *H01Q 5/364* (2015.01); *H01Q 9/0414* (2013.01)

(58) Field of Classification Search
CPC .... H01Q 9/0407; H01Q 5/364; H01Q 9/0414; H01Q 1/36; H01Q 1/48; H01Q 1/50
See application file for complete search history.

(56) References Cited

U.S. PATENT DOCUMENTS

| | | | | |
|---|---|---|---|---|
| 6,404,391 | B1 | 6/2002 | Apostolos | |
| 6,642,893 | B1 | 11/2003 | Hebron et al. | |
| 7,190,322 | B2 | 3/2007 | Apostolos et al. | |
| 8,063,845 | B2 * | 11/2011 | Rabinovich ..... | H01Q 1/3241 343/713 |

(Continued)

FOREIGN PATENT DOCUMENTS

| | | |
|---|---|---|
| CN | 101399395 | 4/2009 |
| CN | 204333252 | 5/2015 |

(Continued)

*Primary Examiner* — Hai V Tran
*Assistant Examiner* — Michael M Bouizza
(74) *Attorney, Agent, or Firm* — Knobbe Martens Olson & Bear LLP

(57) ABSTRACT

The disclosed antenna is designed to work at GPS L1, GPS L2, GPS L5/GLONASS/BEIDOU frequencies. The antenna is fabricated on a flexible body and includes a meander line between a 50Ω RF feeding cable on the ground plane and a patch element. The resonant mechanism is excited by the meander line structure from 1170 Mhz to 1610 MHz and the Patch gives the wideband performance. Most configurations of the antenna have a low profile of about 0.15 mm.

14 Claims, 5 Drawing Sheets

(56) References Cited

U.S. PATENT DOCUMENTS

| | | | | |
|---|---|---|---|---|
| 8,284,105 | B2 * | 10/2012 | Mao | H01Q 1/38 343/700 MS |
| 9,284,105 | B2 | 3/2016 | Ghezzi | |
| 9,692,124 | B2 | 6/2017 | Carni et al. | |
| 9,793,598 | B2 | 10/2017 | Hobson et al. | |
| 2002/0140607 | A1 * | 10/2002 | Zhou | H01Q 1/243 343/700 MS |
| 2004/0104851 | A1 * | 6/2004 | Kadambi | H01Q 1/243 343/700 MS |
| 2005/0248487 | A1 | 11/2005 | Okado | |
| 2007/7252774 | | 11/2007 | Qi et al. | |
| 2010/0123642 | A1 * | 5/2010 | Sanz | H01Q 1/243 343/893 |
| 2011/0221648 | A1 * | 9/2011 | Lee | H01Q 9/285 343/826 |
| 2017/0093019 | A1 | 3/2017 | Toh et al. | |

FOREIGN PATENT DOCUMENTS

| | | |
|---|---|---|
| WO | WO 02/060007 | 8/2002 |
| WO | WO 2010077574 | 7/2010 |

* cited by examiner

SYSTEMS, DEVICES AND METHODS FOR FLEXIBLE MEANDER LINE PATCH ANTENNA

INCORPORATION BY REFERENCE TO ANY PRIORITY APPLICATIONS

This application claims priority to U.S. application Ser. No. 15/401,393, filed Jan. 9, 2017 and issued on Jun. 16, 2019 as U.S. Pat. No. 10,355,360, which claims the benefit of U.S. Provisional Application No. 62/281,009 filed Jan. 20, 2016, and U.S. Provisional Application No. 62/344,818 filed Jun. 2, 2016, which applications are incorporated herein by reference. Any and all applications for which a foreign or domestic priority claim is identified in the Application Data Sheet as filed with the present application are hereby incorporated by reference under 37 CFR 1.57.

INCORPORATION BY REFERENCE

All publications, patents, and patent applications mentioned in this specification are herein incorporated by reference to the same extent as if each individual publication, patent, or patent application was specifically and individually indicated to be incorporated by reference. See, for example, WO 2002/060007 A1 published Aug. 1, 2002, for Meander Line Loaded Tunable Patch Antenna; U.S. Pat. No. 6,404,391 B1 issued Jun. 11, 2002, for Meander Line Loaded Tunable Patch Antenna; U.S. Pat. No. 6,642,893 B1 issue Nov. 4, 2003 for Multi-Band Antenna System Including a Retractable Antenna and a Meander Antenna; U.S. Pat. No. 7,190,322 B2 issued Mar. 13, 2007 for Meander Line Antenna Coupler and Shielded Meander Line; U.S. Pat. No. 8,063,845 B2 issued Nov. 22, 2011 for Symmetrical Printer Meander Dipole Antenna; and U.S. Pat. No. 8,284,105 B2 issued Oct. 9, 2012, for Multi-Band Microstrip Meander-Line Antenna.

BACKGROUND

Technical Field

Previously employed meander line antennas have low bandwidth and low radiation efficiency when the size of the antenna is reduced. While the meander line antenna has advantages due to its small size, low profile and simple structure, there are also disadvantages. The meander line antenna has a low radiation efficiency and when the size of the antenna is reduced, the radiation resistance is also reduced. This results in a decreased radiation efficiency. Additionally, meander line antenna typically have a low bandwidth (less than 5%).

Global Positioning Systems (GPS) systems broadcast microwave signals which can be received by GPS receives on or near the earth's surface to determine location, velocity and time. Currently there are four GPS signals available for civilian use: L1 C/A, L2C, L5 and L1. GLONASS is a space-based satellite navigation system which is used by the Russian Aerospace Defense Forces and is an alternative to GPS. The BeiDou Navigation Satellite System consists of two separate satellite constellations and has been offering navigation services in China and neighboring regions.

What is needed is a flexible antenna employing a meander line which provides stable performance across a plurality of bandwidths without compromising performance.

An antenna is disclosed which has a stable radiation performance across a plurality of bandwidths using a flexible body. A meander line is incorporated to get GPS L1/GPS L2/GPS L5/GLONASS/BeiDou resonances and a patch to increase the bandwidth from 1170 MHz to 1610 Mhz. The patch antenna has a low profile which can be mounted on a flat surface and includes a flat rectangular sheet of metal forming a microstrip transmission line. The flexible body of the antenna allows the antenna to conform to the shape of the surface, including a plurality of bends. The meander line is positioned between a patch element and a 50Ω feeding cable on the ground plane. The patch element is continuous to the meander line and enables an increase in the bandwidth. In at least some configurations, the patch element has a C shape which partially surrounds the meander line. By combining the meander line and the patch in a single antenna structure, the antenna can achieve GPS L1, GPS L2, GPS L5, GLONASS, and BeiDou frequency resonances. Additionally, a mini-coaxial cable can be used as a feeding technique on a ground plane of the antenna which is adjacent the patch and meander line.

An aspect of the disclosure is directed to an antenna comprising: a patch element wherein the patch element has a flat rectangular transmission line; a meander line element which is continuous with the patch element; a 50Ω mini-coaxial feeding cable; and a ground plane, wherein the meander line element is positioned between the patch element and a 50Ω feeding cable on the ground plane. Additionally, the patch element can be a flat rectangular sheet of metal with a low profile. In at least some configurations, the patch element is flexible. The patch element can also be C-shaped and surrounds the meander line element on three sides. The patch element is configurable to be conformable to a mounting surface. In some configurations, the 50Ω mini-coaxial feeding cable has a center conductor at a first end that attaches to the patch element. Additionally, the 50Ω mini-coaxial feeding cable can have an outer conductor attached to the ground plane. Further, wherein the 50Ω mini-coaxial feeding cable has a second end with an SMA connector that attaches to an external electronic device. The ground plane can be positioned adjacent the patch element. Additionally, the ground plane can be rectangular. The ground can also be attached to the 50Ω mini-coaxial feeding cable via an outer conductor.

Another aspect of the disclosure is directed to an antenna comprising: a patch element wherein the patch element has a flat rectangular transmission line; a meander line element which is continuous with the patch element and surrounded by the patch element on three sides; a 50Ω mini-coaxial feeding cable; and a ground plane. Additionally, the patch element can be a flat rectangular sheet of metal with a low profile. In at least some configurations, the patch element is flexible. The meander line element can also be positioned between the patch element and a 50Ω feeding cable on the ground plane. The patch element is configurable to be conformable to a mounting surface. In some configurations, the 50Ω mini-coaxial feeding cable has a center conductor at a first end that attaches to the patch element. Additionally, the 50Ω mini-coaxial feeding cable can have an outer conductor attached to the ground plane. Further, wherein the 50Ω mini-coaxial feeding cable has a second end with an SMA connector that attaches to an external electronic device. The ground plane can be positioned adjacent the patch element. Additionally, the ground plane can be rectangular. The ground can also be attached to the 50Ω mini-coaxial feeding cable via an outer conductor.

Yet another aspect of the disclosure is directed to an antenna means comprising: a patch element means wherein the patch element means has a flat rectangular transmission line; a meander line element means which is continuous with the patch element means; a 50Ω mini-coaxial feeding cable means; and a ground plane means, wherein the meander line element means is positioned between the patch element means and a 50Ω feeding cable on the ground plane means. Additionally, the patch element means can be a flat rectangular sheet of metal with a low profile. In at least some configurations, the patch element means is flexible. The patch element means can also be C-shaped and surrounds the meander line element means on three sides. The patch element means is configurable to be conformable to a mounting surface. In some configurations, the 50Ω mini-coaxial feeding cable means has a center conductor at a first end that attaches to the patch element means. Additionally, the 50Ω mini-coaxial feeding cable means can have an outer conductor attached to the ground plane means. Further, wherein the 50Ω mini-coaxial feeding cable means has a second end with an SMA connector that attaches to an external electronic device. The ground plane means can be positioned adjacent the patch element means. Additionally, the ground plane means can be rectangular. The ground can also be attached to the 50Ω mini-coaxial feeding cable means via an outer conductor.

Still another aspect of the disclosure is directed to an antenna means comprising: a patch element means wherein the patch element means has a flat rectangular transmission line; a meander line element means which is continuous with the patch element means and surrounded by the patch element means on three sides; a 50Ω mini-coaxial feeding cable means; and a ground plane means. Additionally, the patch element means can be a flat rectangular sheet of metal with a low profile. In at least some configurations, the patch element means is flexible. The meander line element means can also be positioned between the patch element means and a 50Ω feeding cable on the ground plane means. The patch element means is configurable to be conformable to a mounting surface. In some configurations, the 50Ω mini-coaxial feeding cable means has a center conductor at a first end that attaches to the patch element means. Additionally, the 50Ω mini-coaxial feeding cable means can have an outer conductor attached to the ground plane means. Further, wherein the 50Ω mini-coaxial feeding cable means has a second end with an SMA connector that attaches to an external electronic device. The ground plane means can be positioned adjacent the patch element means. Additionally, the ground plane means can be rectangular. The ground can also be attached to the 50Ω mini-coaxial feeding cable means via an outer conductor.

SUMMARY

An antenna is disclosed which has a stable radiation performance across a plurality of bandwidths using a flexible body. A meander line is incorporated to get GPS L1/GPS L2/GPS L5/GLONASS/BeiDou resonances and a patch to increase the bandwidth from 1170 MHz to 1610 Mhz. The patch antenna has a low profile which can be mounted on a flat surface and includes a flat rectangular sheet of metal forming a microstrip transmission line. The flexible body of the antenna allows the antenna to conform to the shape of the surface, including a plurality of bends. The meander line is positioned between a patch element and a 50Ω feeding cable on the ground plane. The patch element is continuous to the meander line and enables an increase in the bandwidth. In at least some configurations, the patch element has a C shape which partially surrounds the meander line. By combining the meander line and the patch in a single antenna structure, the antenna can achieve GPS L1, GPS L2, GPS L5, GLONASS, and BeiDou frequency resonances. Additionally, a mini-coaxial cable can be used as a feeding technique on a ground plane of the antenna which is adjacent the patch and meander line.

An aspect of the disclosure is directed to an antenna comprising: a patch element wherein the patch element has a flat rectangular transmission line; a meander line element which is continuous with the patch element; a 50Ω mini-coaxial feeding cable; and a ground plane, wherein the meander line element is positioned between the patch element and a 50Ω feeding cable on the ground plane. Additionally, the patch element can be a flat rectangular sheet of metal with a low profile. In at least some configurations, the patch element is flexible. The patch element can also be C-shaped and surrounds the meander line element on three sides. The patch element is configurable to be conformable to a mounting surface. In some configurations, the 50Ω mini-coaxial feeding cable has a center conductor at a first end that attaches to the patch element. Additionally, the 50Ω mini-coaxial feeding cable can have an outer conductor attached to the ground plane. Further, wherein the 50Ω mini-coaxial feeding cable has a second end with an SMA connector that attaches to an external electronic device. The ground plane can be positioned adjacent the patch element. Additionally, the ground plane can be rectangular. The ground can also be attached to the 50Ω mini-coaxial feeding cable via an outer conductor.

Another aspect of the disclosure is directed to an antenna comprising: a patch element wherein the patch element has a flat rectangular transmission line; a meander line element which is continuous with the patch element and surrounded by the patch element on three sides; a 50Ω mini-coaxial feeding cable; and a ground plane. Additionally, the patch element can be a flat rectangular sheet of metal with a low profile. In at least some configurations, the patch element is flexible. The meander line element can also be positioned between the patch element and a 50Ω feeding cable on the ground plane. The patch element is configurable to be conformable to a mounting surface. In some configurations, the 50Ω mini-coaxial feeding cable has a center conductor at a first end that attaches to the patch element. Additionally, the 50Ω mini-coaxial feeding cable can have an outer conductor attached to the ground plane. Further, wherein the 50Ω mini-coaxial feeding cable has a second end with an SMA connector that attaches to an external electronic device. The ground plane can be positioned adjacent the patch element. Additionally, the ground plane can be rectangular. The ground can also be attached to the 50Ω mini-coaxial feeding cable via an outer conductor.

Yet another aspect of the disclosure is directed to an antenna means comprising: a patch element means wherein the patch element means has a flat rectangular transmission line; a meander line element means which is continuous with the patch element means; a 50Ω mini-coaxial feeding cable means; and a ground plane means, wherein the meander line element means is positioned between the patch element means and a 50Ω feeding cable on the ground plane means. Additionally, the patch element means can be a flat rectangular sheet of metal with a low profile. In at least some configurations, the patch element means is flexible. The patch element means can also be C-shaped and surrounds the meander line element means on three sides. The patch element means is configurable to be conformable to a mounting surface. In some configurations, the 50Ω mini-coaxial feeding cable means has a center conductor at a first end that attaches to the patch element means. Additionally, the 50Ω mini-coaxial feeding cable means can have an outer conductor attached to the ground plane means. Further, wherein the 50Ω mini-coaxial feeding cable means has a second end with an SMA connector that attaches to an external electronic device. The ground plane means can be positioned adjacent the patch element means. Additionally, the ground plane means can be rectangular. The ground can also be attached to the 50Ω mini-coaxial feeding cable means via an outer conductor.

Still another aspect of the disclosure is directed to an antenna means comprising: a patch element means wherein the patch element means has a flat rectangular transmission line; a meander line element means which is continuous with the patch element means and surrounded by the patch element means on three sides; a 50Ω mini-coaxial feeding cable means; and a ground plane means. Additionally, the patch element means can be a flat rectangular sheet of metal with a low profile. In at least some configurations, the patch element means is flexible. The meander line element means can also be positioned between the patch element means and a 50Ω feeding cable on the ground plane means. The patch element means is configurable to be conformable to a mounting surface. In some configurations, the 50Ω mini-coaxial feeding cable means has a center conductor at a first end that attaches to the patch element means. Additionally, the 50Ω mini-coaxial feeding cable means can have an outer conductor attached to the ground plane means. Further, wherein the 50Ω mini-coaxial feeding cable means has a second end with an SMA connector that attaches to an external electronic device. The ground plane means can be positioned adjacent the patch element means. Additionally, the ground plane means can be rectangular. The ground can also be attached to the 50Ω mini-coaxial feeding cable means via an outer conductor.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1A:
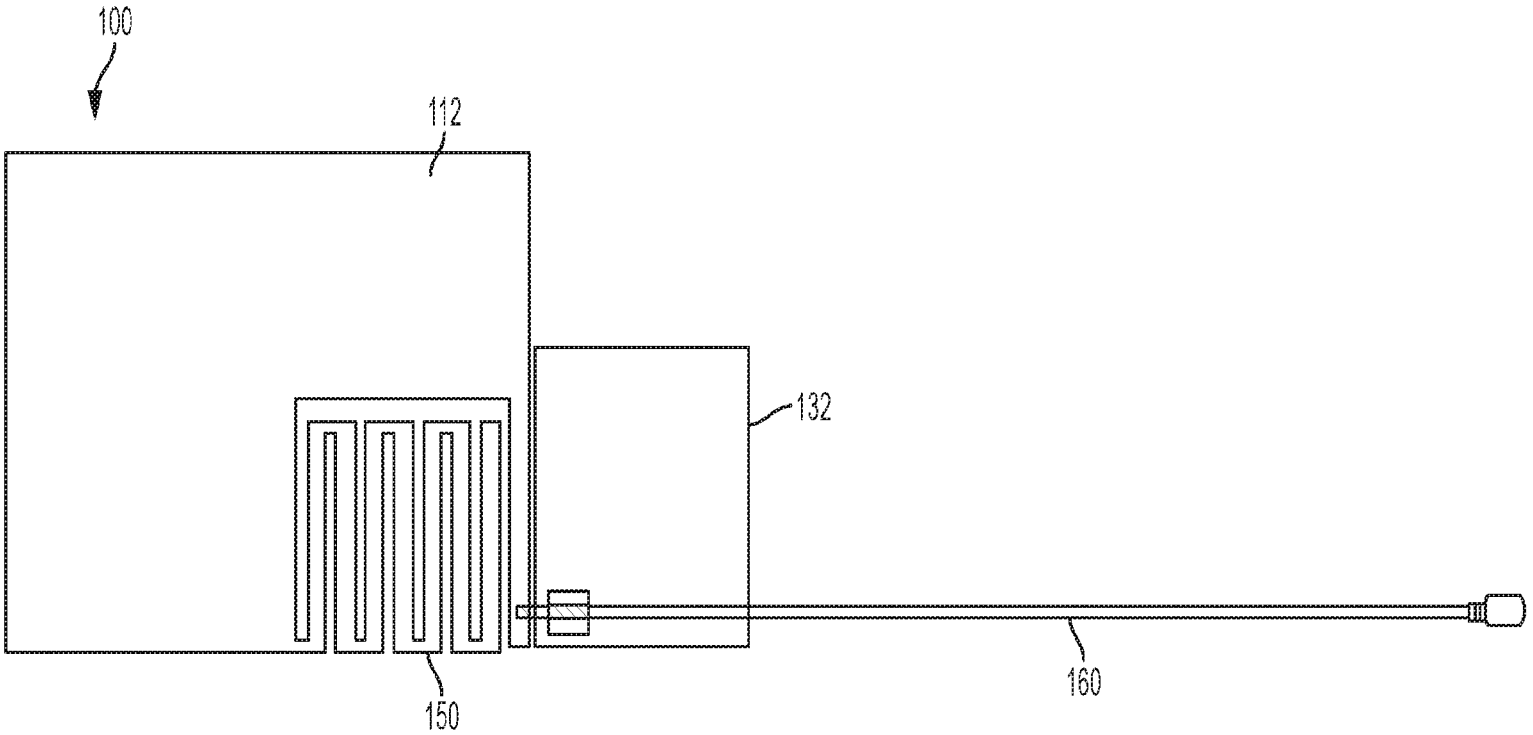
FIG. 1A is a block diagram of an antenna design according to the disclosure.

FIG. 1A is a block diagram of an antenna 100. The antenna 100 has a patch 112 and a meander line 150 with a ground 132. A coaxial cable 160 is connected to the antenna 100 at a location adjacent the meander line 150.

Figure 1B:
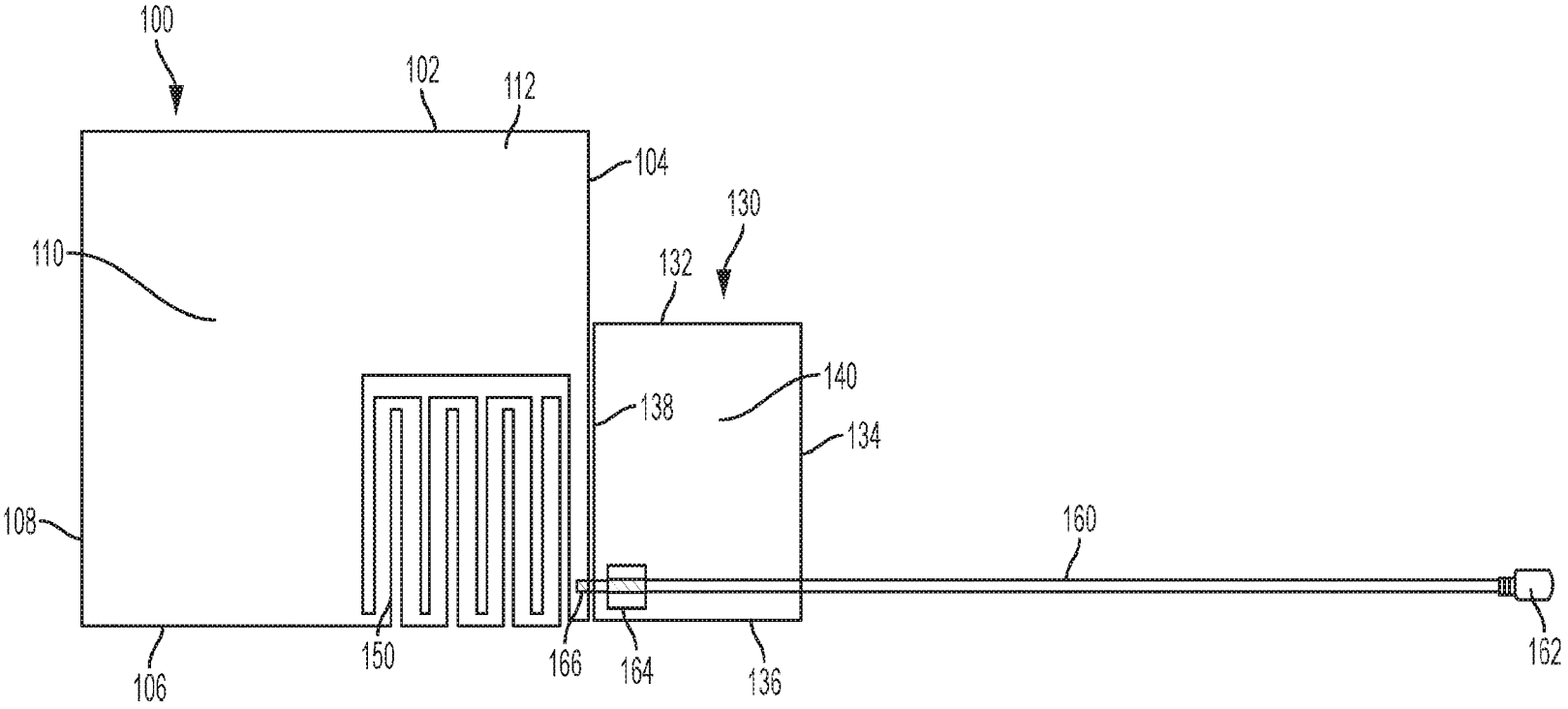
FIG. 1B is a front view of an antenna design according to the disclosure.

FIG. 1B is a front view of an antenna 100 having an antenna top surface 110. The antenna 100 is planar and, as illustrated, has a first side 102, a second side 104, a third side 106 and a fourth side 108, numbered clockwise when viewed from above. The sides can be situated at 90 degree angles so that the resulting surface forms a rectangle (or square) as illustrated. Note that although the depiction in FIG. 1B is planar, the antenna itself is sufficiently thin and flexible such that it can conform to non-planar surfaces. Thus, the installed antenna 100 need not be planar when installed. In the quadrant whose outside edges are defined by sides 104 and 106, is a meander line 150. This meander line 150 zigs-zags from its origin, roughly mid-way between sides 104 and 108, to its terminus near the corner defined by the insertion of sides 104 and 106. The zig-zag has long legs parallel to sides 104 and 108 and short legs perpendicular to sides 104 and parallel to 106. Thus, the patch 112 surrounds the meander line 150 on three sides. The antenna 100 is fed by 50Ω coaxial cable 160. An SMA connector 162 at one end of the coaxial cable 160 provides connection of the antenna 100 to external electronics. A center conductor 166 attaches to the patch 150 portion of antenna 100 near the corner defined by sides 104 and 106, while an outer conductor 164 attaches to the ground plane 130. The ground plane 130 is planar with a top surface 140. It has a first side 132, a second side 134, a third side 136 and a fourth side 138, numbered clockwise when viewed from above. The sides can be situated at 90 degree angles so that the resulting surface forms a rectangle (or square) as illustrated.

Figure 2:
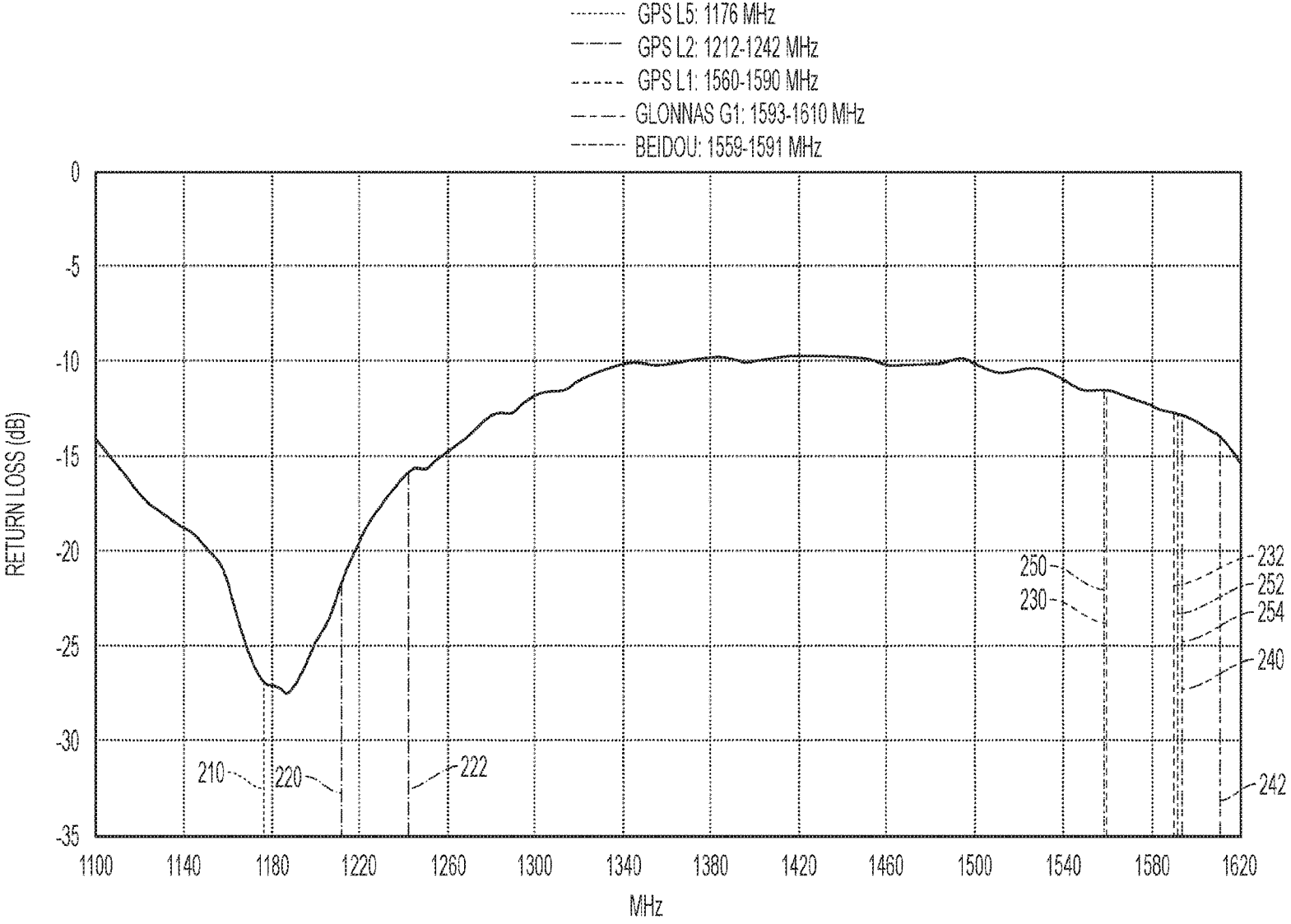
FIG. 2 is a graph illustrating the return loss of the antenna of FIGS. 1A-B.

FIG. 2 is a graph illustrating the return loss of the antenna of FIGS. 1A-B. At 1176 MHz 210, which corresponds to GPS L5, the return loss is approximately −27 dB. Through the GPS L2 range (1212 MHz 220-1242 MHz 222), the return loss increases monotonically from approximately −22 dB at 1212 MHz to approximately −16 dB at 1242 MHz. Across the GPS L range (1560 MHz 230-1590 MHz 232), the return loss decreases monotonically from approximately −12 dB at 1560 MHz 230 to approximately −13 dB at 1590 MHz 232. Through the GLONNAS G1 range (1593 MHz 240-1610 MHz 242), the return loss decreases monotonically from approximately −13 dB at 1593 MHz to approximately −14 dB at 1610 MHz. Across the BEIDOU range (1559 MHz 250-1591 MHz 252), the return loss decreases monotonically from approximately −12 dB at 1559 MHz to approximately −13 dB at 1593 MHz 254.

Figure 3:
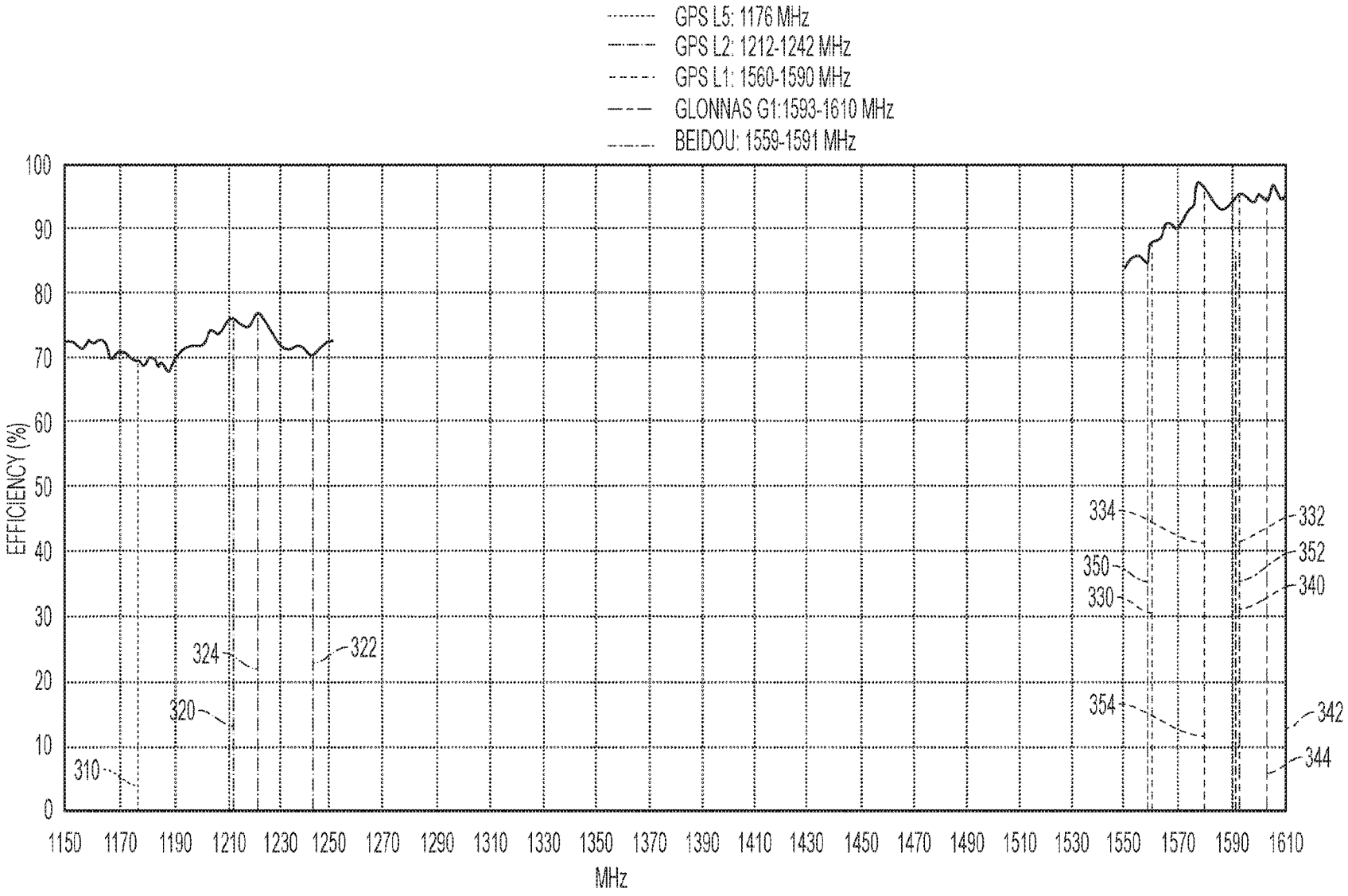
FIG. 3 is a graph illustrating an efficiency of the antenna of FIGS. 1A-B.

FIG. 3 is a graph illustrating an efficiency of the antenna of FIGS. 1A-B at various frequencies between 1150 MHz and 1610 MHz. The efficiency is approximately 69% at 1176 MHz 310, which corresponds to GPS L5. Efficiency through the GPS L2 range (1212 MHz 320-1242 MHz 322) varies from approximately 74% at 1212 MHz 320 to 71% at 1242 MHz 322 with a peak value of approximately 76% at 1222 MHz 324. Efficiency across the GPS L range (1560 MHz 320-1590 MHz 332) varies from approximately 87% at 1560 MHz 330 to 94% at 1590 MHz 332 with a peak value of approximately 97% at 1578 MHz 334. Efficiency through the GLONNAS G1 range (1593 MHz 340-1610 MHz 342) is approximately 95% at either end of the range with a peak value of approximately 96% at 1606 MHz 344. Efficiency across the BEIDOU range (1559 MHz 350-1591 MHz 352) varies from approximately 86% at 1559 MHz 350 to 94% at 1591 MHz 352 with a peak value of approximately 97% at 1578 MHz 354.

Figure 4:
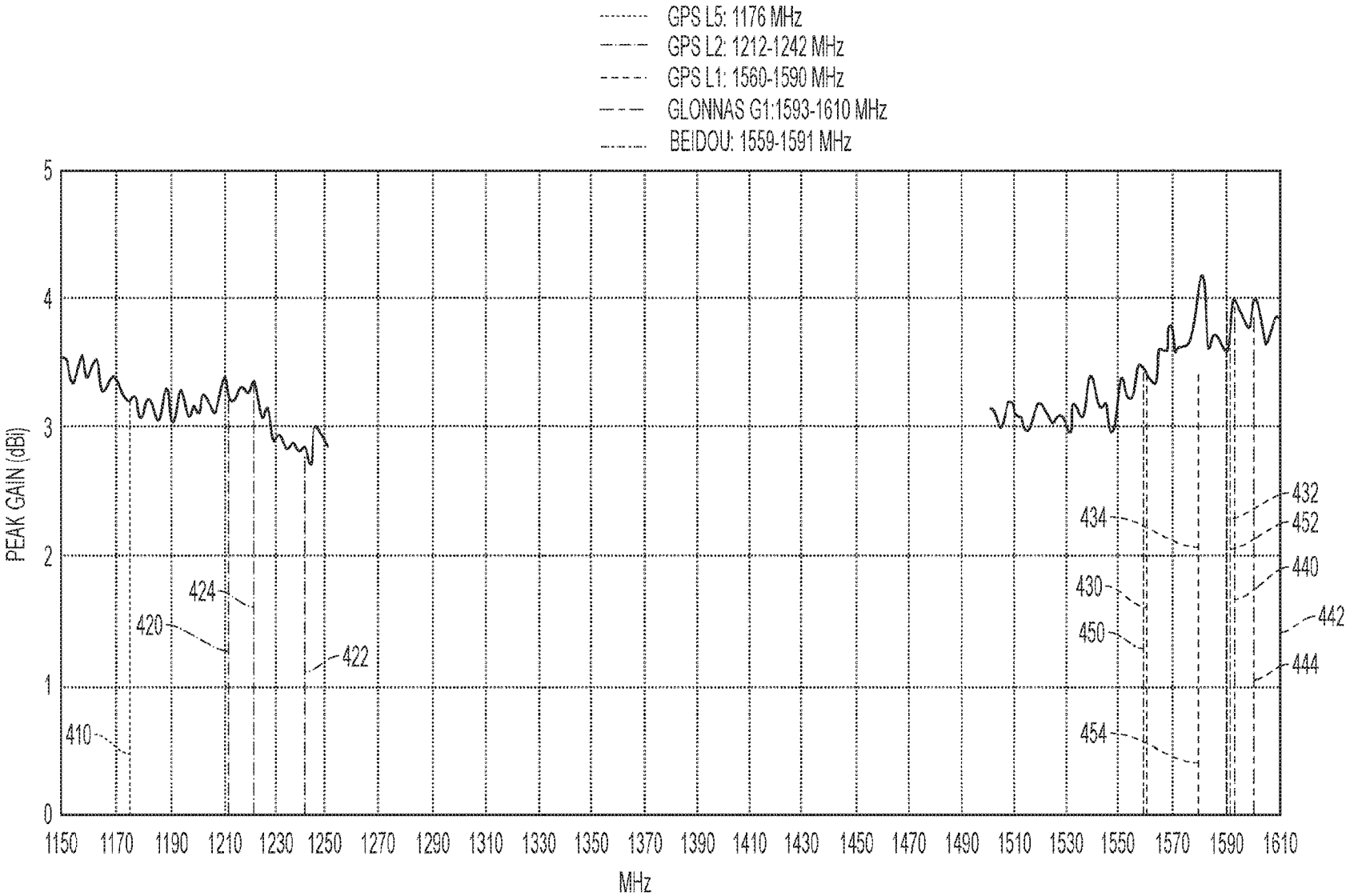
FIG. 4 is a graph illustrating a peak gain of the antenna of FIGS. 1A-B.

FIG. 4 is a graph illustrating a peak gain of the antenna of FIGS. 2A-B at various frequencies between 1150 MHz and 1610 MHz. The peak gain is approximately 3.2 dB at 1176 MHz 410, which corresponds to GPS L5. Peak gain through the GPS L2 range (1212 MHz-1242 MHz 422) varies from approximately 3.4 dB at 1212 MHz 420 to 2.8 dB at 1242 MHz 422 with a maximum value of approximately 3.4 dB at 1212 MHz 420 and 1222 MHz 424. Peak gain across the GPS L1 range (1560 MHz 430-1590 MHz 432) varies from approximately 3.5 dB at 1560 MHz to 3.8 dB at 1590 MHz

432 with a maximum value of approximately 4.1 dB at 1579 MHz 434. Peak gain through the GLONNAS G1 range (1593 MHz 440-1610 MHz 442) varies from approximately 3.9 dB at 1593 MHz 440 to 3.8 dB at 1610 MHz 442 with a maximum value of approximately 4.0 dB at 1601 MHz 444. Peak gain across the BEIDOU range (1559 MHz 450-1591 MHz 452) varies from approximately 3.5 dB at 1559 MHz 450 to 3.8 dB at 1591 MHz 452 with a maximum value of approximately 4.1 dB at 1579 MHz 454.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. An antenna comprising:

a planar patch element located within a rectangular boundary, the planar patch element positioned substantially within three contiguous quadrants of the rectangular boundary;

an open-ended planar meander line positioned within a fourth quadrant of the rectangular boundary and surrounded on at least two sides by the planar patch element, the open-ended planar meander line continuous with the planar patch element at one end of the planar meander line; and a planar ground plane positioned adjacent the planar patch element.

2. The antenna of claim 1, wherein the quadrants of the rectangular boundary are substantially rectangular in shape.

3. The antenna of claim 1, wherein the fourth quadrant of the rectangular boundary comprises outside edges defined by portions of two adjacent sides of the rectangular boundary.

4. The antenna of claim 1, wherein the fourth quadrant of the rectangular boundary comprises an outer edge defined by a first portion of a first side of the rectangular boundary, wherein another quadrant of the three contiguous quadrants of the rectangular boundary comprises an outer edge defined by a second portion of the first side of the rectangular boundary, and wherein the first and second portions of the first side of the rectangular boundary are substantially equal in length.

5. The antenna of claim 1, wherein inner edges of each of the quadrants of the rectangular boundary between adjacent quadrants of the rectangular boundary extend substantially parallel to one of the two sides of the planar patch element surrounding the open-ended planar meander line element.

6. The antenna of claim 1, wherein the planar patch element is flexible.

7. The antenna of claim 1, wherein the planar patch element surrounds the open-ended planar meander line element on three sides.

8. An antenna comprising:

a planar patch element located within a rectangular boundary, the planar patch element located within at least three contiguous quadrants of the rectangular boundary;

an open-ended planar meander line element positioned within a fourth quadrant of the rectangular boundary and surrounded on at least two sides by the planar patch element, the open-ended planar meander line element contiguous with the planar patch element; and a planar ground plane positioned adjacent at least a portion of the planar patch element.

9. The antenna of claim 8, wherein the quadrants of the rectangular boundary are substantially rectangular in shape.

10. The antenna of claim 8, wherein the fourth quadrant of the rectangular boundary comprises outside edges defined by portions of two adjacent sides of the rectangular boundary.

11. The antenna of claim 8, wherein the fourth quadrant of the rectangular boundary comprises an outer edge defined by a first portion of a first side of the rectangular boundary, wherein another quadrant of the three contiguous quadrants of the rectangular boundary comprises an outer edge defined by a second portion of the first side of the rectangular boundary, and wherein the first and second portions of the first side of the rectangular boundary are substantially equal in length.

12. The antenna of claim 8, wherein inner edges of each of the quadrants of the rectangular boundary between adjacent quadrants of the rectangular boundary extend substantially parallel to one of the two sides of the planar patch element surrounding the open-ended planar meander line element.

13. The antenna of claim 8, wherein the planar patch element is flexible.

14. The antenna of claim 8, wherein the planar patch element surrounds the open-ended planar meander line element on three sides.

* * * * *